US008425096B2

(12) United States Patent
Dejmek et al.

(10) Patent No.: US 8,425,096 B2
(45) Date of Patent: Apr. 23, 2013

(54) SIGNAL LIGHT OF MIRROR TYPE

(75) Inventors: Wilfried Dejmek, Frýdek-Místek (CZ); Jakub Lenk, Kutná Hora (CZ); Lumír Soukup, Rybí (CZ)

(73) Assignee: Visteon Global Technologies, Inc., Van Buren, Township, MI (US)

( * ) Notice: Subject to any disclaimer, the term of this patent is extended or adjusted under 35 U.S.C. 154(b) by 517 days.

(21) Appl. No.: 12/698,670

(22) Filed: Feb. 2, 2010

(65) Prior Publication Data

US 2010/0195334 A1 Aug. 5, 2010

(30) Foreign Application Priority Data

Feb. 2, 2009 (CZ) ..... PV 2009-55
Mar. 5, 2009 (CZ) ..... PV 2009-142

(51) Int. Cl.
*F21V 7/00* (2006.01)

(52) U.S. Cl.
USPC ..... 362/517; 362/518; 362/299; 362/327

(58) Field of Classification Search ..... 362/517, 362/518, 299, 300, 301, 327, 328, 346, 348, 362/293
See application file for complete search history.

(56) References Cited

U.S. PATENT DOCUMENTS

| | | | | |
|---|---|---|---|---|
| 3,832,539 | A * | 8/1974 | Oram | 362/293 |
| 5,083,252 | A * | 1/1992 | McGuire | 362/293 |
| 5,967,647 | A * | 10/1999 | Eichler | 362/304 |
| 6,168,294 | B1 * | 1/2001 | Erni et al. | 362/298 |
| 6,953,271 | B2 | 10/2005 | Aynie et al. | |
| 2004/0032739 | A1 * | 2/2004 | Johanson | 362/304 |
| 2004/0114366 | A1 * | 6/2004 | Smith et al. | 362/247 |
| 2006/0171150 | A1 * | 8/2006 | Shimaoka | 362/304 |
| 2006/0176696 | A1 * | 8/2006 | Hough | 362/268 |
| 2007/0097691 | A1 * | 5/2007 | Wu | 362/293 |

FOREIGN PATENT DOCUMENTS

| | | |
|---|---|---|
| DE | 4417695 C2 | 1/1998 |
| DE | 10060639 B4 | 6/2007 |
| DE | 10237262 B4 | 3/2009 |
| EP | 0380663 A1 | 8/1990 |
| EP | 0230834 B1 | 1/1991 |

* cited by examiner

*Primary Examiner* — Joseph L Williams
*Assistant Examiner* — Kevin Quarterman
(74) *Attorney, Agent, or Firm* — Cantor Colburn LLP

(57) ABSTRACT

The signal light of mirror type consists of a light source (1), a primary optical component (2), a secondary optical component (3), a tertiary optical component (4), one or more internal glasses (5), a cover glass (6) and an optical filter (7), characterized in that the light put out by the light source (1) is focused by the primary optical component (2) on the secondary optical component (3), and scattering elements, which are on the primary optical component (2) or on the secondary optical component (3) or on the primary optical component (2) and the secondary optical component (3), after passing through the optical filter (7) are projected onto the tertiary optical component (4), while the tertiary optical component (4) is formed by one or more smooth surfaces of a mirror type, and the image of the scattering elements is further distributed by the tertiary optical component (4) and passes through the one or more internal glasses (5) and the cover glass (6).

19 Claims, 9 Drawing Sheets

SIGNAL LIGHT OF MIRROR TYPE

CROSS-REFERENCE TO RELATED APPLICATION

This application claims priority to Czech Republic Patent Application No. PV 2009-55 filed Feb. 2, 2009, the entire disclosure of which is hereby incorporated herein by reference, and Czech Republic Patent Application No. PV 2009-142 filed Mar. 5, 2009, the entire disclosure of which is hereby incorporated herein by reference.

FIELD OF THE INVENTION

The invention relates to the design of rear and front signal lights and a back-up light (hereinafter merely signal lights) of motor vehicles for land transportation.

PRIOR ART

The optical system of a signal light (functions of a tail light, a clearance light, a brake light, a turn indicator, a back-up light, a rear fog light) in transportation engineering in most cases consists of a light source, a reflector, one or more internal glasses and a cover glass. Collimators with a Fresnel optics can be used to boost the efficiency of the system. Scattering elements are useful for achieving the distribution of light required by regulations. These scattering elements are placed on the reflector, on the internal glasses or on the cover glass. The light exit plane in lights of this design is solid and homogeneous, thanks to the scattering elements. Incandescent bulbs or light-emitting diodes (LEDs) are used as the light source. The optical system of diodes is designed such that each diode has its own reflector or collimator with Fresnel optics.

When the light sources are not shining, one can see the scattering elements on the reflector, on the internal glasses or on the cover glass, and they can be of various size and shape. The surface of these parts beneath the cover glass does not appear entirely smooth.

A signal light can have a single function, a paired function, or a grouped function.

ESSENCE OF THE INVENTION

The aim of the invention of a signal light of mirror type was to achieve a solid and homogeneous light exit plane while at the same time having the surface of the parts beneath the cover glass being solidly smooth, that is, without scattering elements. The technical solution used in the invention likewise makes it possible for the shining light source to not be visible in the direction of the optical axis.

In accordance with the object of this invention, therefore, a signal light of mirror type has been developed, consisting of a light source, a primary optical component, a secondary optical component, a tertiary optical component, one or more internal glasses, a cover glass and an optical filter. The light put out by the light source is focused by the primary optical component on the secondary optical component, while scattering elements, which are on the primary optical component or on the secondary optical component or on the primary optical component and the secondary optical component, after passing through the optical filter are projected onto the tertiary optical component. The tertiary optical component is formed by one or more smooth surfaces of a mirror type, and the image of the scattering elements is further distributed by the tertiary optical component and passes through the one or more internal glasses and the cover glass.

The light source is advantageously formed by several light sources.

The primary optical component is advantageously formed by a reflector with reflective layer.

The primary optical component is preferably a part with light-collimating elements, and the light-collimating elements are located on the first, the second, or on both boundary surfaces of the primary optical component.

The primary optical component can advantageously be composed of a reflector and a part with light-collimating elements.

The secondary optical component is advantageously a part which is completely or partly covered by a reflective layer, and the walls are formed by one or more surfaces of plane or general shape.

The secondary optical component can advantageously be a part whose first wall is formed by one or more surfaces and whose second wall is provided with optical elements of such shape and inclination that total reflection of the light occurs on the second wall.

In an advantageous embodiment, the secondary optical component is designed as a part provided with light diffracting and reflecting elements, wherein the first wall of the secondary optical component is composed of one or more surfaces of such flat or general shape and inclination that total reflection of the light occurs on the surfaces of the secondary optical component, and the surfaces are of plane or general shape.

The tertiary optical component advantageously has scattering elements of various shape and size.

The optical filter advantageously has scattering elements of various shape and size.

In an advantageous embodiment, the optical filter is not part of the signal light.

In an advantageous embodiment, the internal glass is not part of the signal light.

The internal glass and optical filter are advantageously not part of the signal light.

The secondary optical component and optical filter advantageously form a single part, whose top wall or bottom wall or both walls are provided with a reflective layer and scattering elements are on the top wall or bottom wall or both walls.

LIST OF FIGURES IN THE DRAWINGS

The invention will be explained more closely hereafter on the examples of a specific embodiment, which shall be described in regard to the enclosed figures of the drawings, where:

FIGS. 9, 10 and 11 show detail views of the secondary optical component.

Figure 12:
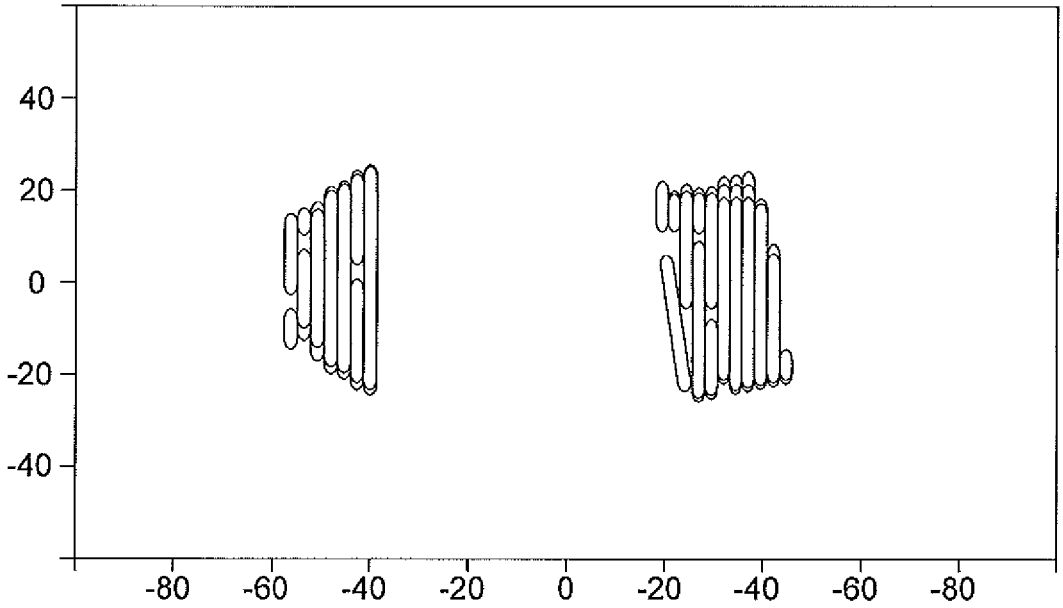

FIG. 12 contains a computer simulation of the illuminating surface of a signal light according to this invention.

Figure 13:
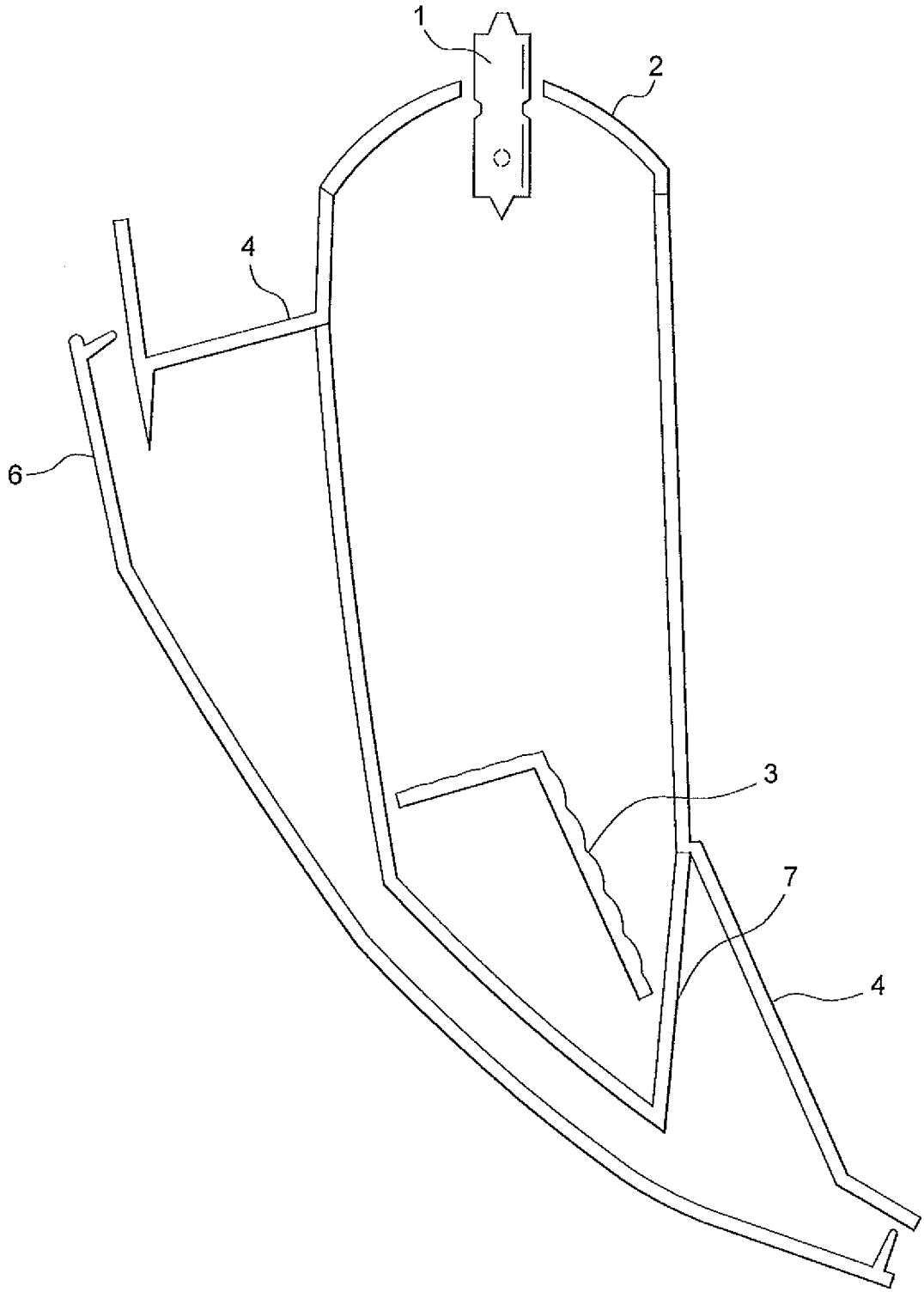

FIG. 13 shows a sample embodiment of the invention, in which an internal glass is not part of the layout.

SAMPLE EMBODIMENT OF THE INVENTION

Figure 1:
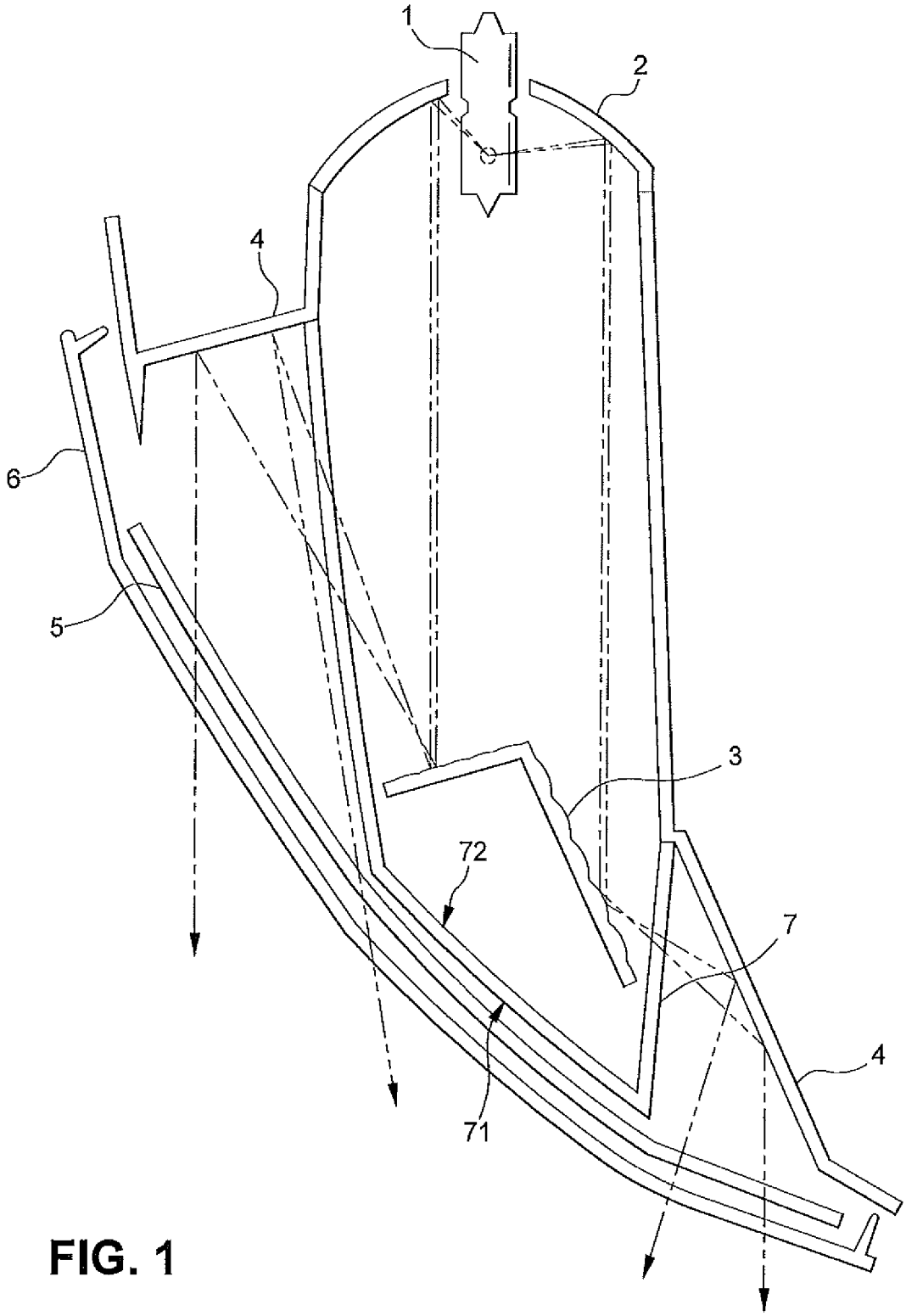
FIG. 1 shows a sectional view of the signal light, in which the scattering elements are on the secondary optical component.

The optical system is illustrated in FIG. 1 and consists of a light source 1, a primary optical component 2, a secondary optical component 3, a tertiary optical component 4, one or more internal glasses 5, a cover glass 6 and an optical filter 7. The internal glasses 5 and the optical filter 7 need not be part of the optical system.

The light put out by the light source 1 is focused by the primary optical component 2 on the secondary optical component 3. Scattering elements, which are on the primary optical component 2 or on the secondary optical component 3 or on both components 2 and 3, after passing through the optical filter 7 are projected onto the tertiary optical component 4. The tertiary optical component 4 is formed by one or more smooth surfaces of a mirror type. The image of the scattering elements formed on the reflective surfaces of the tertiary optical component 4 is further distributed and passes through the one or more internal glasses 5 and the cover glass 6.

Figure 2:
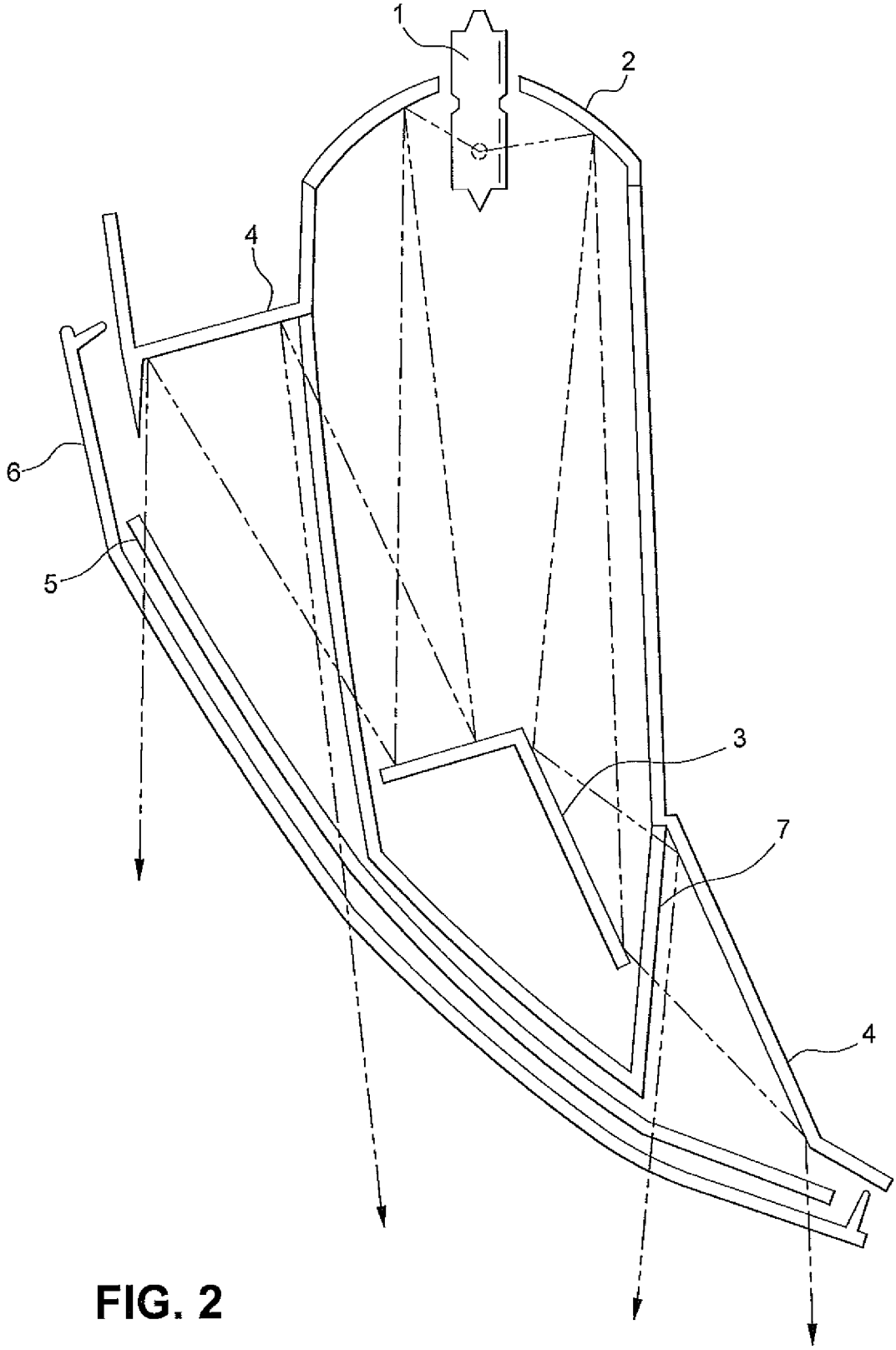
FIG. 2 shows a sectional view of the signal light, in which the scattering elements are on the primary optical component.
Figure 3:
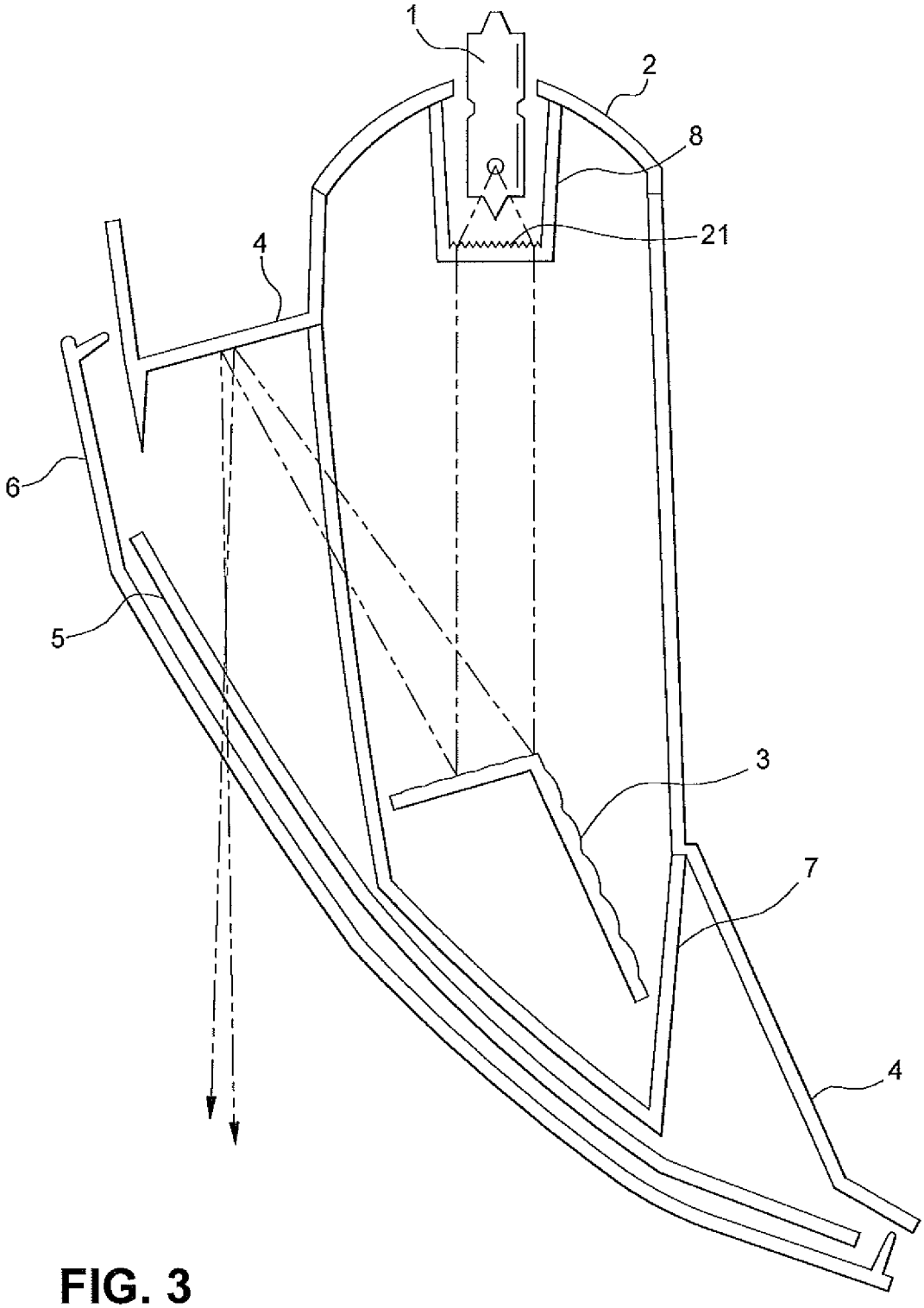
FIG. 3 illustrates an optical system containing a collimator with collimating elements of Fresnel optics on the first boundary surface (21) of the primary optical component.
Figure 4:
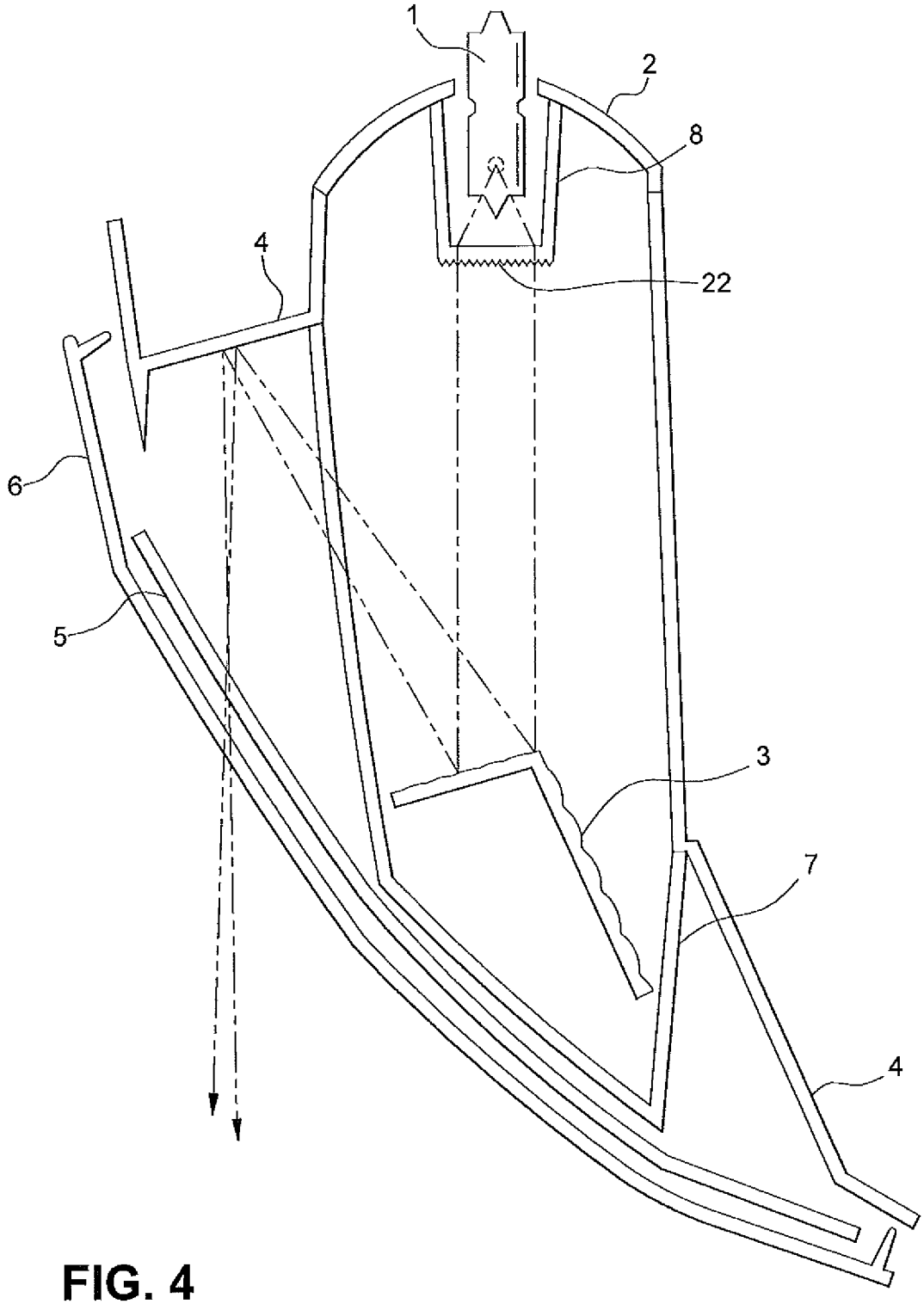
FIG. 4 illustrates an optical system containing a collimator with collimating elements of Fresnel optics on the second boundary surface of the primary optical component.

FIG. 1 illustrates the situation when the scattering elements are on the secondary optical component 3. FIG. 2 illustrates the situation when the scattering elements are on the primary optical component 2.

The scattering elements can also be on the optical filter 7. In this case, there can be scattering elements on the primary optical component 2 or the secondary optical component 2 [sic], but these are not necessary.

Various kinds of incandescent bulbs (single-filament and double-filament) or light-emitting diodes can be used as the light source 1.

The primary optical component 2 can be a reflector of parabolic type, a spherical reflector, an elliptical reflector, a collimator 8 with Fresnel optics, or combinations of these. Collimating elements with Fresnel optics can be placed on the first 21, second 22, or both boundary surfaces of the collimator 8. The decision as to which variant of the primary optical component to use depends on the kind of light source (incandescent bulb or light-emitting diode), the general magnitudes of the signal function and the type of signal function (tail light, clearance light, brake light, turn indicator, back-up light, rear fog light). The critical factor is that the primary optical component should produce a sufficiently strong light beam.

Figure 5:
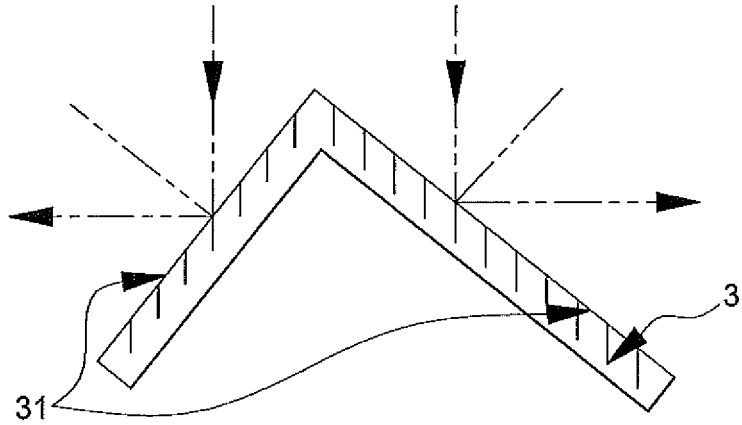
FIG. 5 illustrates a detail of the signal light, showing the condition when light is reflected by the reflective layer on the first wall of the secondary optical component.
Figure 6:
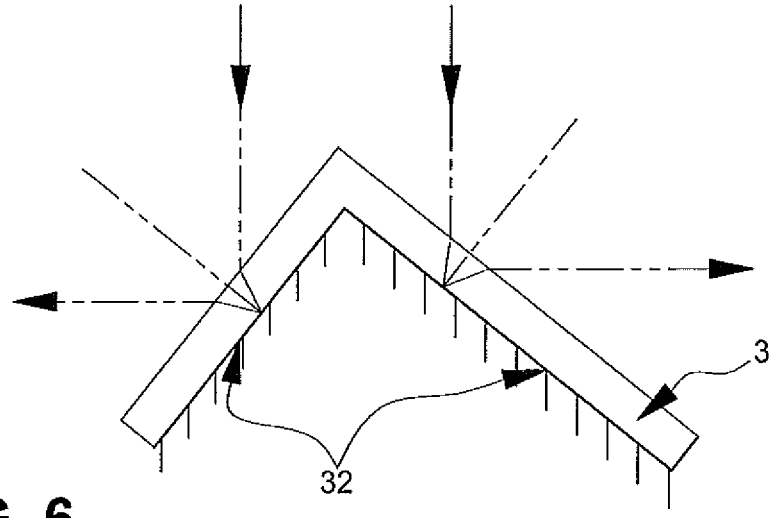
FIG. 6 illustrates a detail of the signal light, showing the condition when light is reflected by the reflective layer on the second wall of the secondary optical component.
Figure 7:
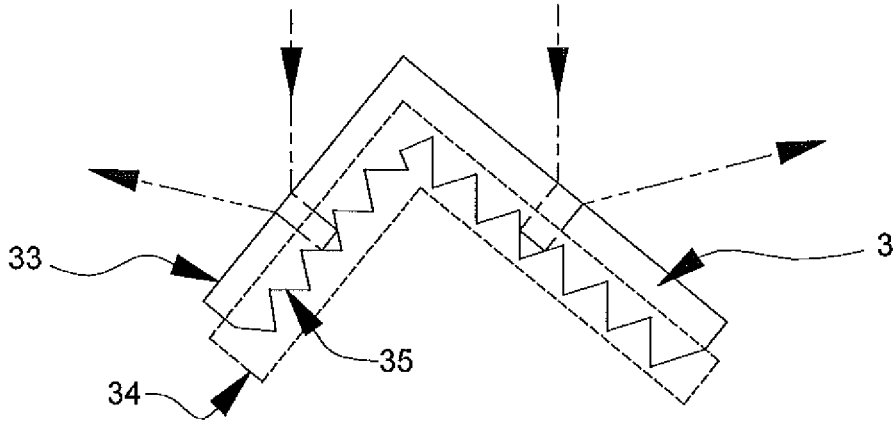
FIG. 7 illustrates a detail of the signal light, showing the condition when light passes through the first wall, total reflection of the light occurs on the optical components, and the light is then directed toward the third optical component.
Figure 8:
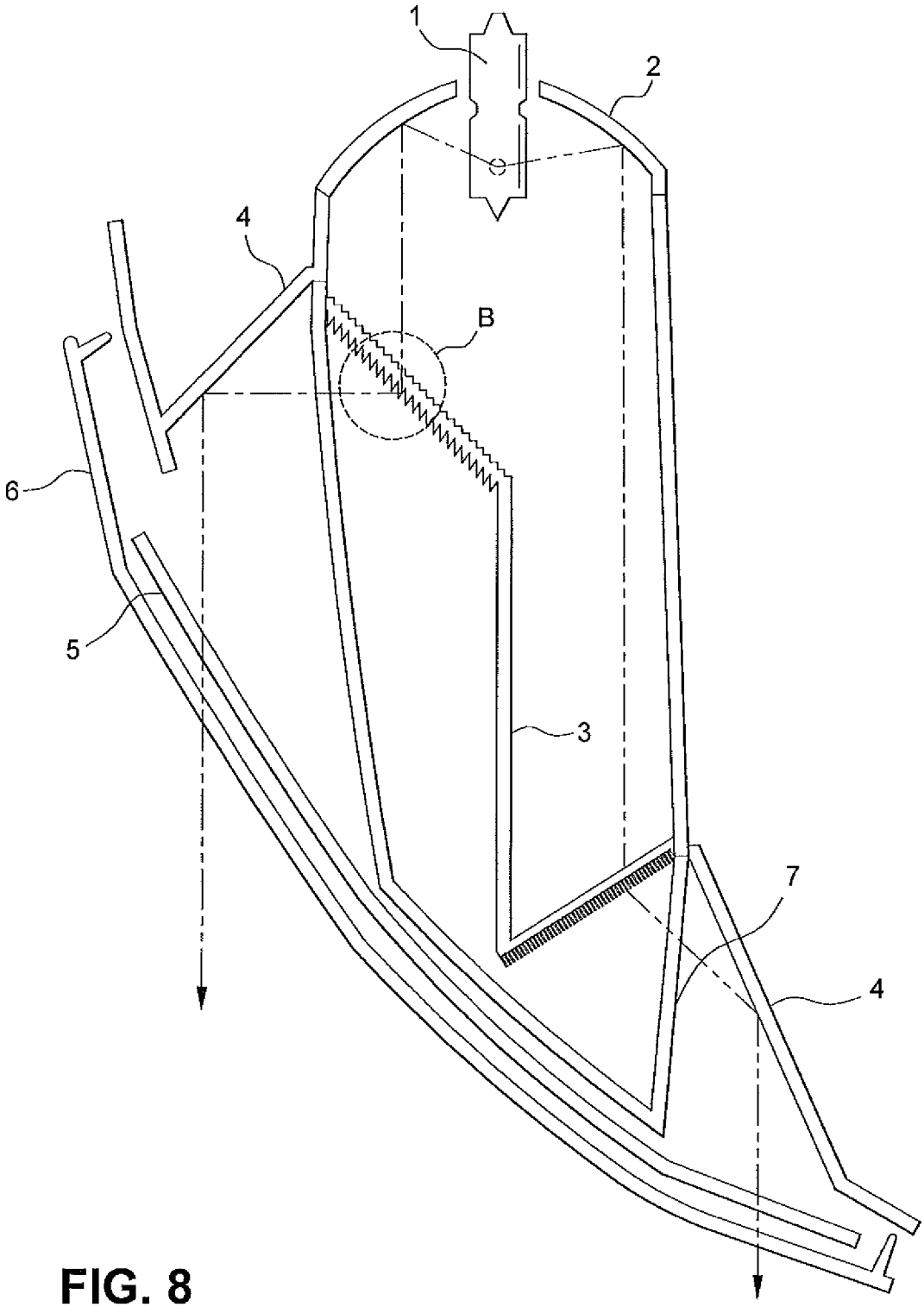
FIGS. 8, 9, 10 and 11 show an optical system in which the first wall of the secondary optical component is composed of one or more surfaces which make angles with the rays emanating from the light source and the primary optical component such that total reflection of the light occurs on the surfaces of the secondary optical component.
Figure 9:
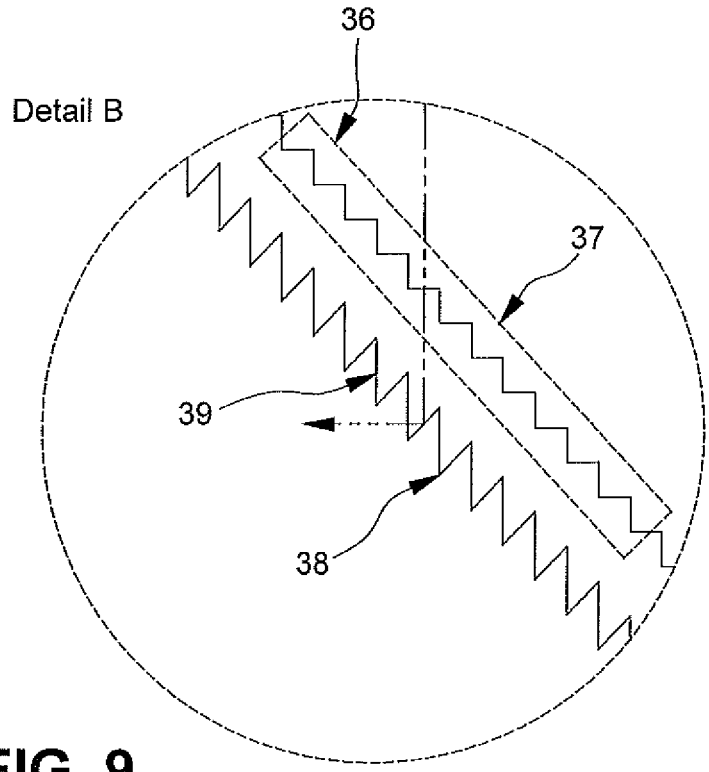

The secondary optical component 3 is formed by scattering elements, which scatter light in vertical, horizontal, or both directions. The secondary optical component 3 can have a shape as depicted in the figures or a different shape which guarantees that light going from the primary optical component 2 and the light source 1 is reflected by the secondary optical component 3 onto all surfaces of the tertiary optical component 4. The light impinging on the secondary optical component 3 is reflected at the reflective layer, which is on the first wall 31 (illustrated in FIG. 5) or on the second wall (illustrated in FIG. 6). Other design variants of the secondary optical component 3 make use of total reflection of the light. In one of the variants, the fourth wall 34 of the secondary optical component 3 is provided with optical elements 35 on which total reflection of the light occurs, for example, reflecting prisms. The principle is illustrated in FIG. 7. Light passes through the third wall 33, it is totally reflected by the optical elements 35, and then the light is directed toward the tertiary optical component 4. In terms of the design of the shape of the part, it is useful to establish the direction of polishing such that no slanting occurs on the optical elements 35. A situation may occur in which it will not be possible to polish the secondary optical component 3 as a single part, and it will have to be made from two or more parts, which will be provided with optical elements 35.

Figure 10:
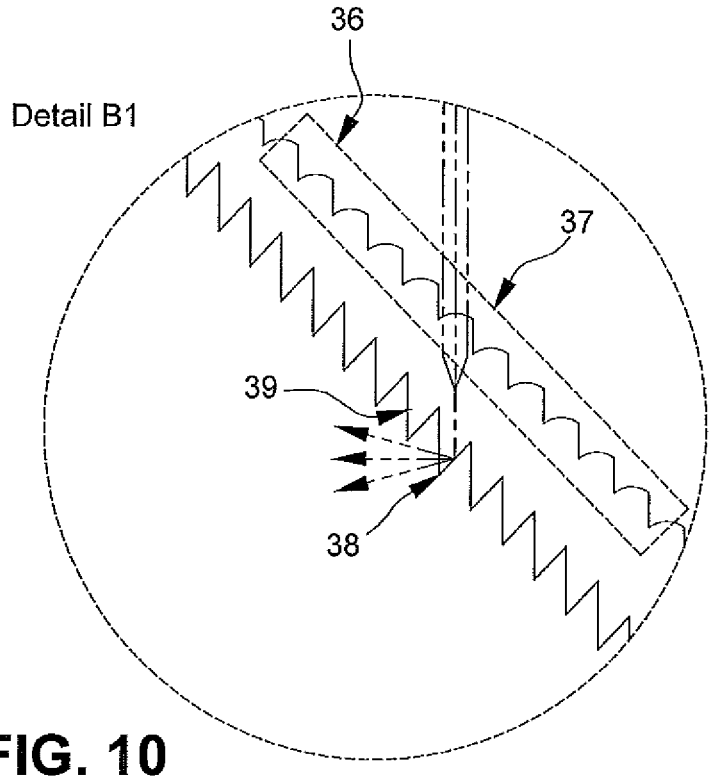
Figure 11:
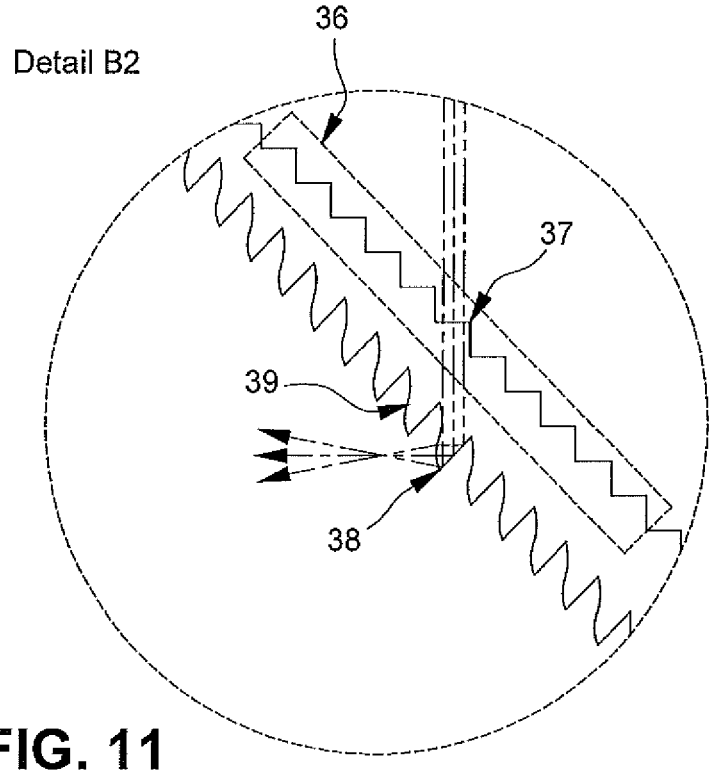

Another variant is illustrated in FIGS. 8, 9, 10 and 11. The fifth wall 36 of the secondary optical component 3 is composed of one or more surfaces 37 which make angles with the rays coming from the light source 1 and the primary optical component 2 so that total reflection of the light occurs on the surfaces 38 of the secondary optical component 3. The light then propagates toward the surfaces 39 of the secondary optical component 3. The light is diffracted on the surfaces 39 and exits from the secondary optical component 3. The surfaces 37 and 39 can be provided with light-scattering elements, as can be seen in FIGS. 10 and 11.

The scattering optical elements of the secondary optical component 3 cannot be seen when the light is not turned on. If the light source 1 is shining, the scattering optical elements of the secondary optical component 3 are projected onto the tertiary optical component 4. If an optical filter 7 is present in the optical system, the light will pass through the filter before impinging on the tertiary optical component 4.

The tertiary optical component 4 has the form of a reflector. A primary goal of the invention is for this to be smooth and level, but this is not an absolute condition. It is possible to have an ordinary shape and to have scattering elements on it, if this is required for esthetic reasons. The light is reflected by the tertiary optical component 4 and passes through one or more internal glasses 5 and a cover glass 6 and exits from the signal light. The internal glasses 5 need not be present in the optical system of the signal light of mirror type. An advantage of the invention is that, if the tertiary optical component 4 is smooth and level, the exit plane of the light is solid and homogeneous. A simulation of the turned-on state, produced by means of computer, is illustrated in FIG. 12.

When adopting the invention in the design of signal lights, it is possible to combine individual elements of the described optical system or, on the other hand, to separate them (for example, the primary and tertiary optical component can be fabricated as a single part). The decision as to which elements to combine or which ones to separate will depend on the specific situation.

In transportation engineering, it is useful for the chromaticity coordinates of the light of individual signal functions to be in a prescribed desired range. In the context of the described invention, this is accomplished by a color combination of materials that are used to make:

the primary optical component 2, if it has the nature of a collimator with Fresnel optics, the optical filter 7, the internal glasses 5, and the cover glass 6.

The invention makes it possible for the light source in the turned-on condition to not be visible in the direction of the optical axis. This can be accomplished by these techniques:

a) The secondary optical component 3 is covered by a reflective layer.

b) To the secondary optical component 3 is attached an exterior part, which is covered by an aluminum reflective layer or made of nontransparent material.

c) The top wall 71 or bottom wall 72 of the optical filter 7 is covered with a reflective layer.

FIG. 13 shows a sectional view of a signal light, specifically, the signal function of a turn indicator. An aluminum reflective layer is deposited by vapor technique on the reflective surfaces of the primary, secondary and tertiary optical [components]. The internal glass 6 is not part of the system.

A light bulb H21W is used. Other types of light bulb can be used depending on the efficiency of the optical system, for example, clear bulbs P21W, W21W, W16W, orange bulbs PY21W, HY21W, WY21W, or also LED sources.

There exist several variants for the color arrangement of an optical filter 7 and cover glass 6. Besides others, there are these variants:

1. orange color of optical filter 7, clear color of the cover glass 6 and clear incandescent bulb,
2. clear color of optical filter 7, orange color of cover glass 6 and clear incandescent bulb,
3. green color of optical filter 7, pink color of cover glass 6 and clear incandescent bulb,
4. blue color of optical filter 7, pink color of cover glass 6 and orange incandescent bulb.

Of course, it is always necessary for the resulting color spectrum given by the combinations of colors of the filter and the glass to correspond to the chromaticity coordinates of the light of the individual signal functions in the prescribed desired interval.

The light in this embodiment has a very forceful and completely different appearance in the on and off state than the customary designs. Also from the standpoint of the light parameters, this design of light satisfies the current legal regulations.

INDUSTRIAL USEFULNESS

The signal light of mirror type can be used in transportation engineering to make signal lights and grouped signal lights of nontraditional appearance. Thanks to the possibility of using standard light sources and similar designs, this solution is comparable in production and cost to the classical lights.

LIST OF REFERENCE NUMBERS

1 light source
2 primary optical component
3 secondary optical component
4 tertiary optical component
5 internal glass
6 cover glass
7 optical filter
8 collimator
21 first boundary surface
22 second boundary surface
31 first wall
32 second wall
33 third wall
34 fourth wall
35 optical elements
36 fifth wall
37 surface
38 surface 38 of secondary optical component 3
39 surface 39 of secondary optical component 3
71 top wall
72 bottom wall

What is claimed is:

1. A mirror type signal light comprising:

a light source (1) for emitting a light;

a primary optical component (2) for directing the light in a first desired direction;

a secondary optical component (3) for directing the light in a second desired direction, wherein the light emitted by the light source (1) is focused by the primary optical component (2) on the secondary optical component (3);

a tertiary optical component (4) for directing the light in a third desired direction, wherein the tertiary optical component (4) includes at least one mirror type smooth surface and receives the light from the secondary optical component (3);

a cover glass (6) through which the light is transmitted from the tertiary optical component (4);

at least one internal glass (5) disposed between the tertiary optical component (4) and the cover glass (6); an optical filter (7) disposed between the secondary optical component (3) and the tertiary optical component (4); and a plurality of scattering elements formed on at least one of the primary optical component (2) and the secondary optical component (3) to scatter the light directed thereby, wherein the light after passing through the optical filter (7) is projected onto the tertiary optical component (4), and the light from the scattering elements is further distributed by the tertiary optical component (4) and passes through the at least one internal glass (5) and the cover glass (6).

2. The mirror type signal light according to claim 1, wherein the light source (1) is formed by several light sources.

3. The mirror type signal light according to claim 1, wherein the primary optical component (2) is a reflector with a reflective layer.

4. The mirror type signal light according to claim 1, wherein the primary optical component (2) includes light-collimating elements, and the light-collimating elements are located on at least one of a first boundary surface (21) and a second boundary surface (22) of the primary optical component (2).

5. The mirror type signal light according to claim 1, wherein the primary optical component (2) includes a reflector and light-collimating elements.

6. The mirror type signal light according to claim 1, wherein the secondary optical component (3) is at least partly covered by a reflective layer, and includes a first wall (31) and a second wall (32).

7. The mirror type signal light according to claim 1, wherein the secondary optical component (3) includes a third wall (33) formed by one or more surfaces and a fourth wall (34) having optical elements (35) of sufficient shape and inclination to substantially totally reflect the light at the fourth wall (34).

8. The mirror type signal light according to claim 1, wherein the secondary optical component (3) has light diffracting and reflecting elements, wherein a fifth wall (36) of the secondary optical component (3) includes at least one first surface (37) of sufficient shape and inclination that the total reflection of the light occurs on at least one second surface (38) of the secondary optical component (3), and the light then propogates toward at least one third surface (39) of the secondary optical component (3).

9. The mirror type signal light according to claim 1, wherein the tertiary optical component (4) has the scattering elements of various shape and size.

10. The mirror type signal light according to claim 1, wherein the optical filter (7) has the scattering elements of various shape and size.

11. The mirror type signal light according to claim 1, wherein the secondary optical component (3) and the optical filter (7) are integrally formed and include at least one of a top wall (71) and a bottom wall (72) with a reflective layer and the scattering elements disposed thereon.

12. A mirror type signal light comprising:

a light source for emitting a light;

a primary optical component for directing the light in a first desired direction;

a secondary optical component for directing the light in a second desired direction;

a tertiary optical component for directing the light in a third desired direction, wherein the tertiary optical component is formed by at least one substantially smooth surface of a mirror type;

a cover glass for transmitting the light therethrough; and a plurality of scattering elements formed on at least one of the primary optical component and the secondary optical component to scatter the light directed thereby, wherein the light after passing through an optical filter is projected onto the tertiary optical component, and the light from the scattering elements is further distributed by the tertiary optical component and passes through an internal glass disposed between the tertiary optical component and the cover glass.

13. The signal light according to claim 12, wherein the light source is formed by several light sources.

14. The signal light according to claim 12, wherein the primary optical component is a reflector with reflective layer.

15. The signal light according to claim 12, wherein the primary optical component includes light-collimating elements, and the light-collimating elements are located on at least one of a first boundary surface and a second boundary surface of the primary optical component.

16. The signal light according to claim 12, wherein the primary optical component includes a reflector and light-collimating elements.

17. The signal light according to claim 12, further comprising an optical filter disposed between the secondary optical component and the tertiary optical component.

18. The signal light according to claim 12, further comprising an internal glass disposed between the tertiary optical component and the cover glass.

19. The signal light according to claim 12, further comprising an optical filter disposed between the secondary optical component and the tertiary optical component, and an internal glass disposed between the tertiary optical component and the cover glass.

* * * * *